US005632872A

United States Patent [19]

Dattilo

[11] Patent Number: 5,632,872

[45] Date of Patent: May 27, 1997

[54] COMPOSITE ELECTRICAL ELECTRODE AND A METHOD FOR FORMING THE SAME

[75] Inventor: Marion Dattilo, 17601 Road 8220, Rolla, Mo. 65401

[73] Assignee: Marion Dattilo, Rolla, Mo.

[21] Appl. No.: 493,023

[22] Filed: Jun. 21, 1995

[51] Int. Cl.$^6$ ..... C25B 11/00

[52] U.S. Cl. ..... 204/290 R; 204/290 F; 204/291

[58] Field of Search ..... 204/290 R, 290 F, 204/291

[56] References Cited

U.S. PATENT DOCUMENTS 4,118,294 10/1978 Pellegri ..... 204/291

4,153,742 5/1979 Böehn et al ..... 204/290 F 4,834,847 5/1989 McIntyre ..... 204/294

4,927,800 5/1990 Nishiki et al. ..... 204/291

*Primary Examiner*—Bruce F. Bell

*Attorney, Agent, or Firm*—Michael R. Swartz

[57] ABSTRACT

A composite electrode for supporting an anodic or cathodic electrochemical reaction such as occurs during a metal electrowinning process has a composition which includes between 90 and 95 weight percent of an electrically conductive metal compound and between 5 and 10 weight percent of a polymeric binder material blended with the conductive metal compound. The composite electrode is formed under a maximum pressure of 2.5 metric tons per square centimeter and at a temperature between ambient and 140 degrees C.

8 Claims, No Drawings

COMPOSITE ELECTRICAL ELECTRODE AND A METHOD FOR FORMING THE SAME

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates generally to an electrode applicable to various electrolytic processes or devices and, more particularly, to a composite electrode for supporting an anodic or cathodic electrochemical reaction and a method for forming the same.

2. Description of the Prior Art

As is well known in the art, there are several types of electrodes used in the electrowinning of metals. The types of electrodes most generally used for anodic applications in an electrowinning process fall into three main groups: lead alloy; precious metal clad or deposited on titanium; and carbon-based electrodes. Each of these electrode types has their advantages and disadvantages which are well published in the literature. It is also widely known that these different electrode types are expensive to make and that they have a less than desirable useful lifetime. For example, lead-based electrodes used in a metal electrowinning process have high oxygen over potentials which result in high energy consumption that lowers the economic viability of the electrowinning process itself. As electricity costs drive the price for electrowon lead above the market value, the lead-based electrowinning process becomes no longer feasible from an economic standpoint. In addition, atmospheric and other environmental emissions standards have made the pyrometallurgical production and recycle of lead less attractive because of cost and pollution problems. The present trend will become more acute and force the lead industry to resort to the lowered pollution process of electrolysis.

Composite electrodes have been suggested for use as anodes in a metal electrowinning process. The composite electrodes described in the available literature are primarily bonded by a fluorocarbon polymer, such as polytetrafluoroethylene, and the amount of binder material included in a typical composite electrode far exceeds 10% of the overall weight percent of the electrode itself. This greatly increases the cost of composite electrodes because of the high cost of fluorocarbon polymers. In addition, the use of a fluorocarbon polymer, such as polytetrafluoroethylene, as a binder material greatly reduces the mechanical strength of the electrode and thus diminishes the desirability of using these composite electrodes as anodes in a metal electrowinning process.

Additionally, it would be desirable to use a composite electrode as the cathode in certain metal electrowinning situations and other electrochemical systems because of system chemistry or physical properties since the present known cathode compositions are sometimes undesirable.

Each of the electrode types either used or suggested for use in a metal electrowinning process is not without its shortcomings. Consequently, there is a need for an improved composite electrode for use in supporting an anodic or cathodic electrochemical reaction such as occurs in a metal electrowinning process that overcomes the shortcomings of electrodes known and used today. The improved electrode must be less expensive to manufacture than presently used electrodes, be simple in construction, and should be capable of operating for a longer period of time and require less energy to operate than presently known and utilized electrodes. Additionally, when the electrode is used as an anode, it must avoid the use of a substrate metal for support of the metal oxides serving as the site for anodic electrochemical reactions.

SUMMARY OF THE INVENTION

The present invention relates to a composite electrode for supporting an anodic or cathodic electrochemical reaction such as occurs in a metal electrowinning process designed to satisfy the aforementioned needs. The composite electrode of the present invention is relatively inexpensive to manufacture, has a longer operating life and requires less energy to operate than presently known and used electrodes.

Accordingly, the present invention is directed to a simple monolithic composite electrode for supporting an anodic or cathodic electrochemical reaction. The preferred composite electrode is composed of: (a) between 90 and 95 weight percent of a least one electrically conductive metal compound; and (b) between 5 and 10 weight percent of a non-conductive polymeric binder blended with the metal compound. In forming an anode, the metal compound is preferably a metal oxide or a mixture of metal oxides, whereas, in forming a cathode, the metal compound is preferably a metal carbide, phosphide, nitride, or mixture thereof.

These and other features and advantages of the present invention will become apparent to those skilled in the art upon a reading of the following detailed description wherein there is described an illustrative embodiment of the invention.

DETAILED DESCRIPTION OF THE INVENTION

The type of electrode described herein is applicable to various electrolytic processes or devices which recover metals, provide energy, decontaminate waste products in slurries, or provide the site for oxidation electrochemical reactions. The following text is presented from the standpoint of improving metal electrowinning and more particularly lead electrowinning since energy utilization is of paramount economic concern in the lead-based process. However, it should be understood that the composite electrode described herein may be applied to other electrolytic processes such as the electrowinning of zinc and copper with similar results.

The present invention is directed to a composite electrode for supporting an anodic or cathodic electrochemical reaction such as occurs in a metal electrowinning process. In forming an anode, the composite electrode of the present invention is composed of either one or two electrically conductive metal oxide powders, making up between 90 and 95 weight percent of the total weight of the electrode, held together by a non-conductive material in the form of a polymeric binder which comprises between 5 and 10 weight percent of the total weight of the electrode. On the otherhand, in forming a cathode, the composite electrode of the present invention is composed of either one or two electrically conductive metal carbides, phosphides or nitride powders, making up between 90 and 95 weight percent of the total weight of the electrode, held together by a non-conductive material in the form of a polymeric binder which comprises between 5 and 10 weight percent of the total weight of the electrode. Preferably, the polymeric material is polyethylene. The composite electrode may also contain a metal-mesh or other polymer reinforcement material to provide added physical strength or integrity.

The composition of the electrode is selected and tailored to the process in which it will be used. The factors affecting the composition of the composite electrode are chemical and electrochemical in nature. In the case of an anode for use in an electrolytic cell to electroplate metal, the materials used to form the composite electrode must be resistant to corrosion since oxidation reactions typically occur at the anode and normally this oxidation is the breakdown of water into oxygen gas and corrosion-causing acid.

Preferably, if the composite electrode is to be used to support an anodic electrochemical reaction such as occurs during the electrowinning of lead from a lead fluosilicic, fluoboric, or alkyl-sulfonic acid medium, the composition of the composite electrode comprises a mixture of between 65 and 95 weight percent lead dioxide and between 0 and 30 weight percent manganese dioxide as the conductive metal compound component; and about 5 weight percent of a polymeric binder, such as polyethylene, as the non-conductive material component. However, if the composite electrode is to be used to support a cathodic electrochemical reaction, then the composition for the cathode would preferably be between 90 and 95 weight percent tungsten carbide as the conductive metal compound component and the balance of 5 to 10 weight percent of the polymeric binder material.

Formation of the composite electrode is done at high pressures up to 2.5 metric tons per square centimeter of electrode surface area, and the temperature of the press may vary between ambient temperature and 140 degrees C. The electrode may contain a metal-mesh or other reinforcement material embedded in the lead dioxide/manganese dioxide mixture upon electrode formation to provide added physical strength or integrity.

It is thought that the present invention and many of its attendant advantages will be understood from the foregoing description and it will be apparent that various changes may be made in the form of the invention described herein without departing from the spirit and scope of the invention or sacrificing all of its material advantages, the form hereinbefore described being merely a preferred or exemplary embodiment thereof.

I claim:

1. A composite electrode for supporting an electrochemical reaction, comprising:

(a) a mixture composed of between 90 and 95 weight percent of an electrically conductive metal compound powder and between 5 and 10 weight percent of a polyethylene blended with said metal compound powder;

(b) said mixture being pressed to form said composite electrode in a monolithic structure having a substantially uniform composition at ambient temperature to bond the components of said mixture together.

2. The composite electrode as recited in claim 1, wherein said conductive metal compound powder is a metal oxide.

3. The composite electrode as recited in claim 2, wherein said metal oxide is lead dioxide.

4. The composite electrode as recited in claim 1, wherein said conductive metal compound powder is a combination of lead dioxide and manganese dioxide.

5. The composite electrode as recited in claim 4, wherein said combination consists of between 65 and 95 weight percent lead dioxide and between 0 and 30 weight percent manganese dioxide.

6. The composite electrode as recited in claim 1, wherein said conductive metal compound powder is one selected from the group consisting of a metal carbide, a metal phosphide, a metal nitride, and a combination thereof.

7. The composite electrode as recited in claim 6, wherein said conductive metal compound powder is tungsten carbide.

8. The composite electrode as recited in claim 1, wherein said mixture is subjected to a maximum pressure of 2.5 metric tons per square centimeter to form said composite electrode.

* * * * *